US010399000B1

(12) United States Patent
Fisher

(10) Patent No.: US 10,399,000 B1
(45) Date of Patent: Sep. 3, 2019

(54) FLYING DISK WITH AIRFOILS

(71) Applicant: Myles A Fisher, Panama City Beach, FL (US)

(72) Inventor: Myles A Fisher, Panama City Beach, FL (US)

( * ) Notice: Subject to any disclaimer, the term of this patent is extended or adjusted under 35 U.S.C. 154(b) by 0 days.

(21) Appl. No.: 16/207,042

(22) Filed: Nov. 30, 2018

(51) Int. Cl.
*A63H 33/18* (2006.01)
*A63B 65/00* (2006.01)

(52) U.S. Cl.
CPC ..... *A63H 33/18* (2013.01)

(58) Field of Classification Search
CPC ..... A63H 27/00; A63H 27/12; A63H 27/14; A63H 33/00; A63H 33/18; A63B 65/00; A63B 65/05; A63B 67/06
USPC ..... 446/46–48; 473/588–590
See application file for complete search history.

(56) References Cited

U.S. PATENT DOCUMENTS 3,939,602 A * 2/1976 Burke ..... A63H 33/18 446/48
4,203,249 A * 5/1980 Bohm ..... A63H 33/18 446/48
5,340,347 A * 8/1994 Yenerich ..... A63H 33/18 446/48
5,816,879 A * 10/1998 Kyame ..... A63H 33/18 446/48
6,390,879 B1 * 5/2002 Spector ..... A63H 3/003 446/369
8,113,905 B2 * 2/2012 Davis ..... A63H 27/12 244/12.2
D724,156 S 3/2015 Fisher
D729,322 S 5/2015 Fisher
2014/0127963 A1 * 5/2014 Wechsler ..... A63H 33/18 446/48

* cited by examiner

*Primary Examiner* — Kien T Nguyen
(74) *Attorney, Agent, or Firm* — Peter Loffler

(57) ABSTRACT

An aerodynamic flying device combines features of a flying disk and a boomerang. The device uses a closed dome flying disk with one or more cambered wings attached to the disk. The wings have their leading edges facing in the direction of rotation of the disk. The wings may be asymmetrically cambered or may be symmetrically cambered about the center line of each wing. An outer ring is attached to the outer edges of each wing. A downwardly dependent curved rim runs along the outer periphery of the device with a discontinuity of the rim occurring along the joinder line whereat each wing attaches to the disk. Another discontinuity of the rim may occur along a portion of the trailing edge of each wing.

30 Claims, 9 Drawing Sheets

FLYING DISK WITH AIRFOILS

BACKGROUND OF THE INVENTION

1. Field of the Invention

The present invention relates to a flying disk that has one or more airfoils attachable thereto, either fixedly or removably, in order to enhance the flight characteristics of the disk, the invention having characteristics of both a flying disk and a boomerang.

2. Background of the Prior Art

The flying disk is a disk-shaped gliding object that has a closed dome curving to a downwardly depending circumferential rim and is used for throwing and catching by recreationalists the world over. Walter Fredrick Morrison developed a disk which he called the Pluto Platter and which became a huge commercial success. The Pluto Platter is considered the archetype for all modern flying disks. Morrison, who was awarded design patent D183,626 in 1964 for the Pluto Platter, sold the Pluto Platter to Wham-O Holding, Ltd., of Kowloon, Hong Kong, the prior year. Wham-O's general manager and vice president for marketing, Edward Headrick, redesigned the Pluto Platter and sold the redesigned flying disk under the registered trademark name FRISBEE, a name associated with flying disks the world over. Headrick was awarded U.S. Pat. No. 3,359,678 for his redesigned flying disk. Millions of FRISBEES as well as flying disks made by companies other than Wham-O are produced each year and enjoyed by flying disk enthusiasts everywhere.

The flying disk is both an airfoil and a gyroscope that has a varied center of mass, center of gravity, center of rotation and moment of inertia. By being an airfoil, the flying disk depends on Bernoulli's principle of lift in that air flowing around a cambered airfoil, the air is flowing over the top curved wing surface at a greater speed relative to the air flowing over the flat underside of the airfoil. The different air velocities over the two surfaces result in a pressure differential between the top surface of the airfoil and the underside of the airfoil. As pressure is inversely proportional to air velocity, the greater air velocity over the top surface of the air foil results in a pressure drop on the top surface relative to the slower relative air flow velocity on the underside of the airfoil, which yields a greater pressure. This pressure differential results in lift as the higher pressure on the underside of the airfoil pushes the airfoil toward the lower pressure on the top side of the airfoil. Many flying disks have a series of small concentric ridges which act as turbulators which help reduce air flow separation thereby reducing drag and increasing airfoil lift.

The flying disk depends on rotational velocity and the associated moment of inertia (gyroscopic precession, which stabilizes the disk's attitude in flight) to stay airborne. The downwardly depending rim of the flying disk creates considerable drag for the flying disk in flight, however, the thick rim increases the disk flight stability by increasing the moment of inertia and its associated gyroscopic precession. The rim also serves to cup the air and act as a parachute, enabling the flying disk to have a slow soft hover to landing as the flying disk loses sufficient lift and begins to succumb to increased drag and gravity.

The flying disk is considered a one-way device in that, when thrown properly, the flying disk does not return to the thrower. The flying disk flies with a slightly raised angle of attack (slight nose up configuration) and the disk's center of gravity is located at the geometric center of the disk.

A boomerang is a thrown tool that has been used for both hunting and sport, although modern boomerangs are used almost exclusively for sport. There are many variations on the boomerang including one-way boomerangs that do not return to the thrower and two-way or out and back boomerangs that, if thrown properly, fly in a circular or elliptical path and return to the thrower. Modern boomerangs are mostly returning boomerangs.

The boomerang has one or more wings that, like the flying disk, are cambered airfoils, the returning boomerang having at least two such airfoils joined at an elbow. Like the flying disk, the boomerang depends on rotational velocity and the associated moment of inertia to stay aloft. The leading edge of each wing (the thick edge) of a boomerang is oriented to fly into the air as the boomerang rotates. As a result, there are right-handed boomerangs that have counterclockwise rotation in flight and left-handed boomerangs that have clockwise rotation in flight (flying disks are ambidextrous). A boomerang achieves far greater rotation velocities relative to a flying disk. The return of a returning boomerang results from the fact that the greatest lift is achieved at the wing tip of the airfoil flying into the wind as this wing tip has the greatest velocity due to the fact that the velocity is the sum of the rotational velocity plus the oncoming air velocity (lineal velocity) while the "off" wing velocity (the opposing wing in a two wing design) is the rotational velocity minus the lineal velocity of the boomerang with the resultant decreased lift on the off wing. The resultant action is that the wing flying into the air generates greater lift than the lift generated by the off wing causing the boomerang to pivot and constantly turn about its center of mass and center of rotation.

As the flight of a boomerang progresses, the rotational velocity of the boomerang slows, and on the return flight path the boomerang spins more slowly, slowing to an almost hover and then falls to the ground as the loss of linear velocity causes drag to exceed lift and loss of moment of inertia causes instability in flight, so that gravity takes over and the boomerang stalls.

Both the flying disk and the boomerang have certain beneficial flight characteristics that are unique to their respective architectures. While each device is enjoyed by many, combining these beneficial features into a single device can create a throwing device with advanced flight dynamics with lower terminal flight velocities than a boomerang, and with return to thrower flight characteristics not capable in flying disks alone.

SUMMARY OF THE INVENTION

The flying disk with airfoils of the present invention addresses the aforementioned desires in the art by combining the features of a standard flying disk with the features of a boomerang so as to enhance the overall flight characteristics of the device when compared to either the flying disk or the boomerang alone. This combination results in a device that uses two different airfoil systems combined with two different gyroscope systems. The result is a flying disk with greater lift and greater angular rotation so that greater lineal distances and greater airtime and better return flight path characteristics can be achieved relative to either a flying disk or a boomerang alone.

The flying disk with airfoil of the present invention comprises a disk member that has a closed dome circular disk member having an upper surface and a lower surface.

A cambered first wing has a first leading edge, a first trailing edge, and a first outer edge between the first leading edge and the first trailing edge, and is attached directly to the disk member along a first joinder line. A cambered second wing has a second leading edge, a second trailing edge, and a second outer edge between the second leading edge and the second trailing edge, and is attached directly to the disk member along a second joinder line. A cambered third wing has a third leading edge, a third trailing edge, and a third outer edge between the third leading edge and the third trailing edge, and is attached directly to the disk member along a third joinder line. The first wing, the second wing, and the third wing are substantially similar to one another and are spaced equidistantly apart from one another about the flying disk. The disk member, the attached first wing, the attached second wing, and the attached third wing having an overall outer periphery. A downwardly depending curved rim is located along the outer periphery of the disk member such that there is a first discontinuity of the rim along the first joinder line, a second discontinuity of the rim along the second joinder line, and a third discontinuity of the rim along the third joinder line—as the three joinder lines are all of the same length, each of these three discontinuities is of the same length. Attachment means for attaching an accessory (whistle, light warbler, etc.,) to the disk member may be located on the disk member and can comprise a pair of coextensive rails located on the lower surface such that the accessory is held between the pair of rails within channels thereat. The disk member is cambered. A first turbulator is located on the first leading edge of the first wing while a second turbulator is located on the second leading edge of the second wing, a third turbulator is located on the third leading edge of the third wing. The first wing, the second wing, and the third wing may be either symmetrically cambered or asymmetrically cambered along a midline passing through each respective wing. A fourth turbulator is located on the first trailing edge of the first wing while a fifth turbulator is located on the second trailing edge of the second wing and a sixth turbulator is located on the third trailing edge of the third wing—these three turbulators may be an extension of the first, second, and third turbulators, respectively, past the midline of their respective wing. The flying disk, the first wing, the second wing, and the third wing may all be monolithic in construction. A ring member is attached to a portion of the first outer edge of the first wing, to a portion of the second outer edge of the second wing, and to a portion of the outer edge of the third wing. A fourth discontinuity of the rim may be located along the first trailing edge of the first wing, a fifth discontinuity of the rim may be located along the second trailing edge of the second wing, and a sixth discontinuity of the rim may be located along the third trailing edge of the third wing, these three discontinuities all being of the same length and having the same taper if provided.

BRIEF DESCRIPTION OF THE DRAWINGS

Similar reference numerals refer to similar parts throughout the several views of the drawings.

DESCRIPTION OF THE PREFERRED EMBODIMENT

Figure 1:
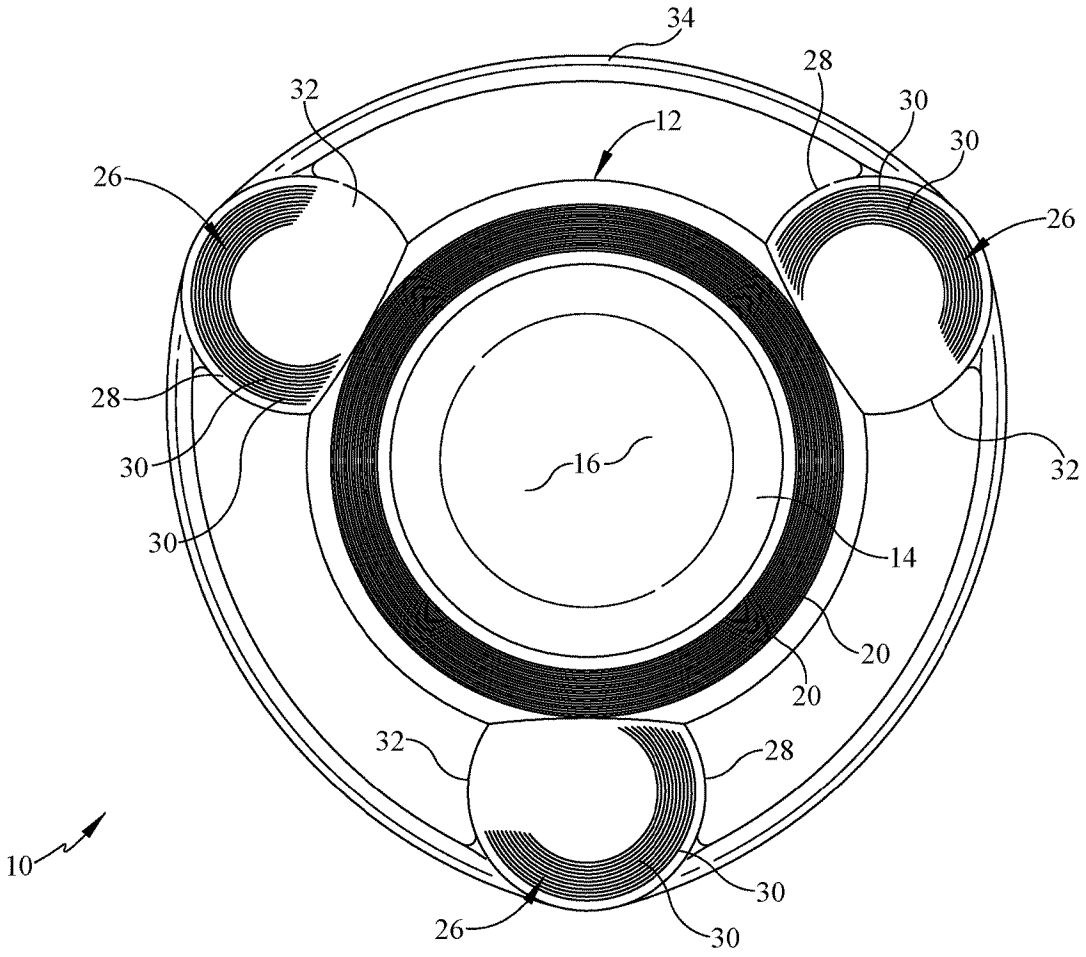
FIG. 1 is a top view of the flying disk with airfoils of the present invention.
Figure 2:
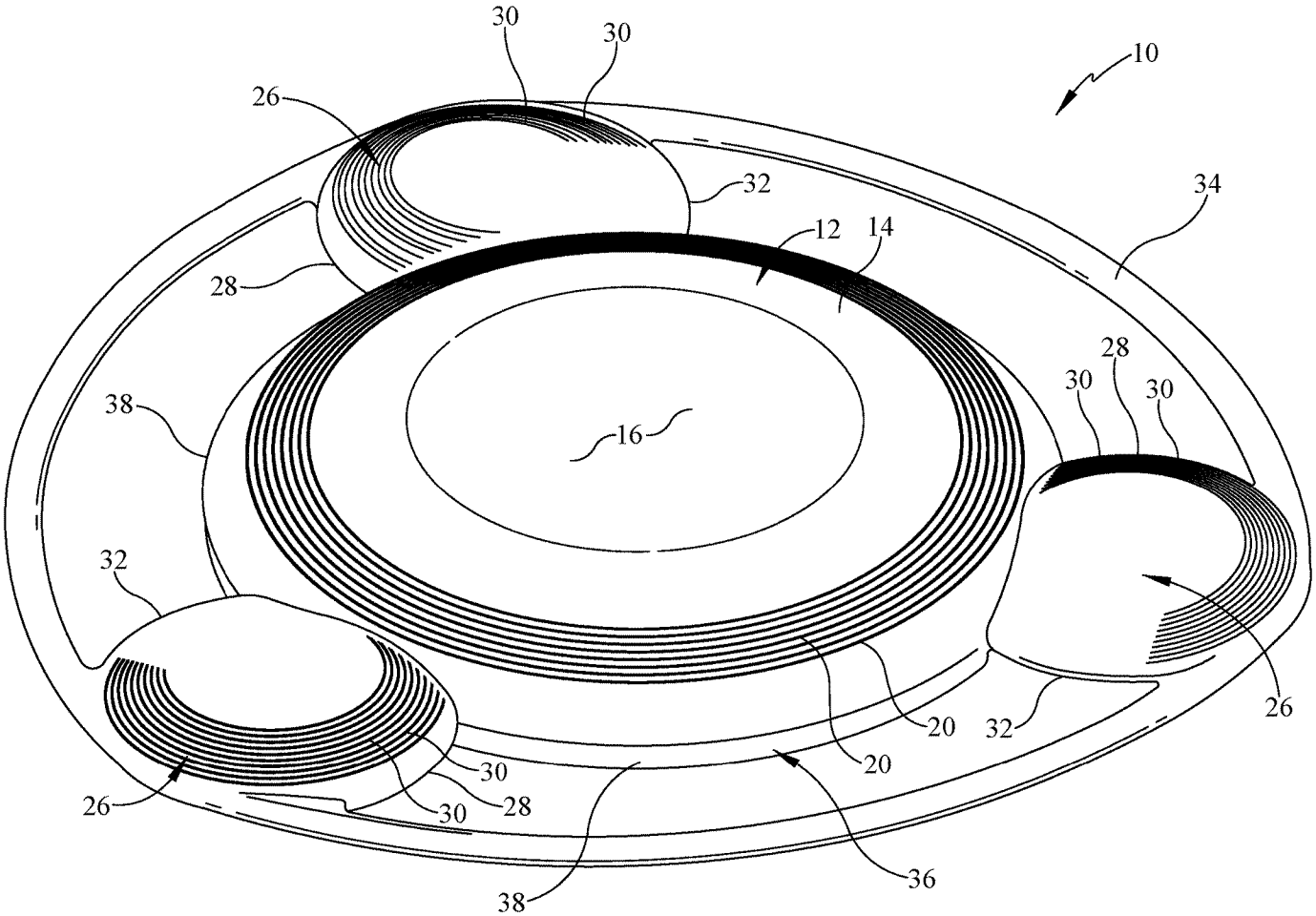
FIG. 2 is a topside perspective view of the flying disk with airfoils.
Figure 3:
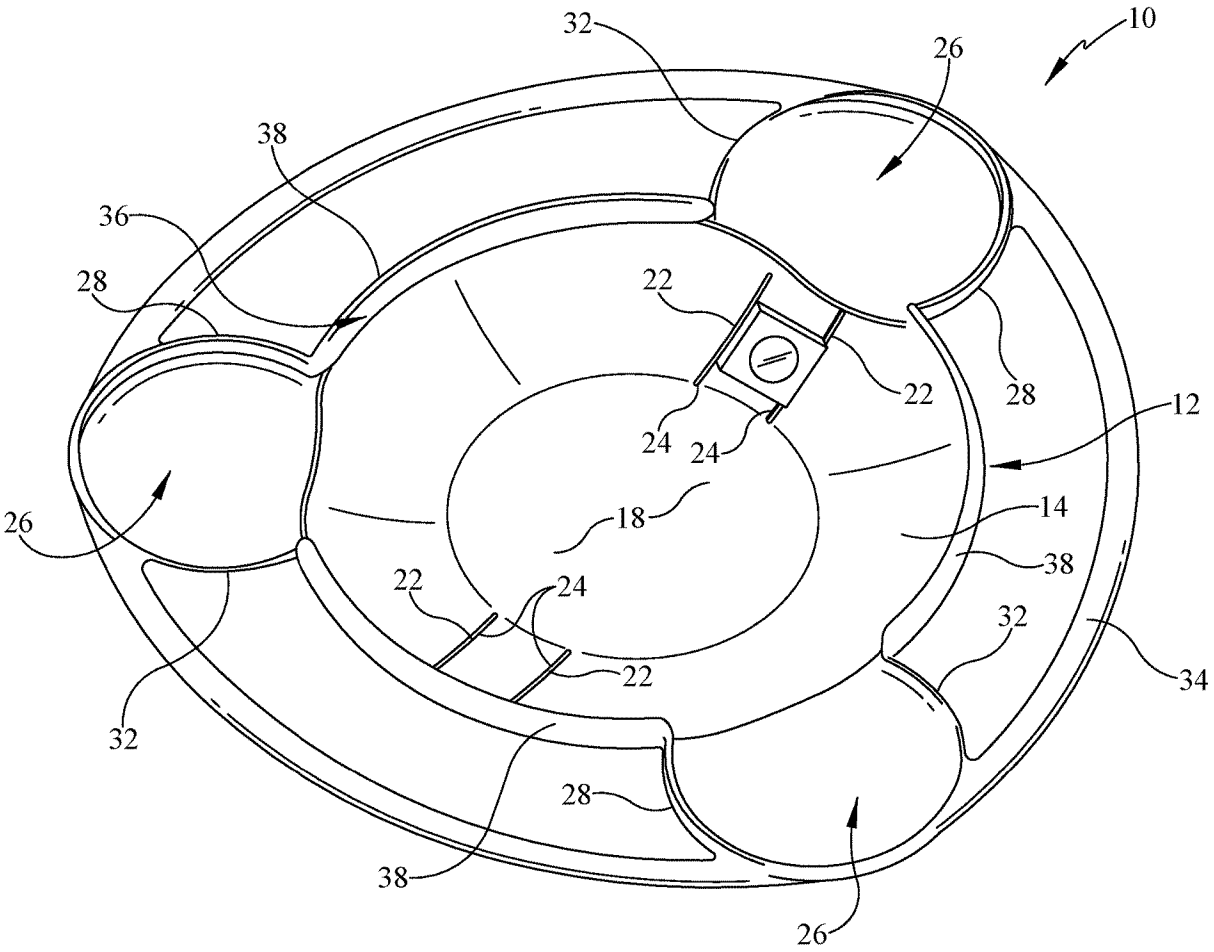
FIG. 3 is an underside perspective view of the flying disk with airfoils.
Figure 4:
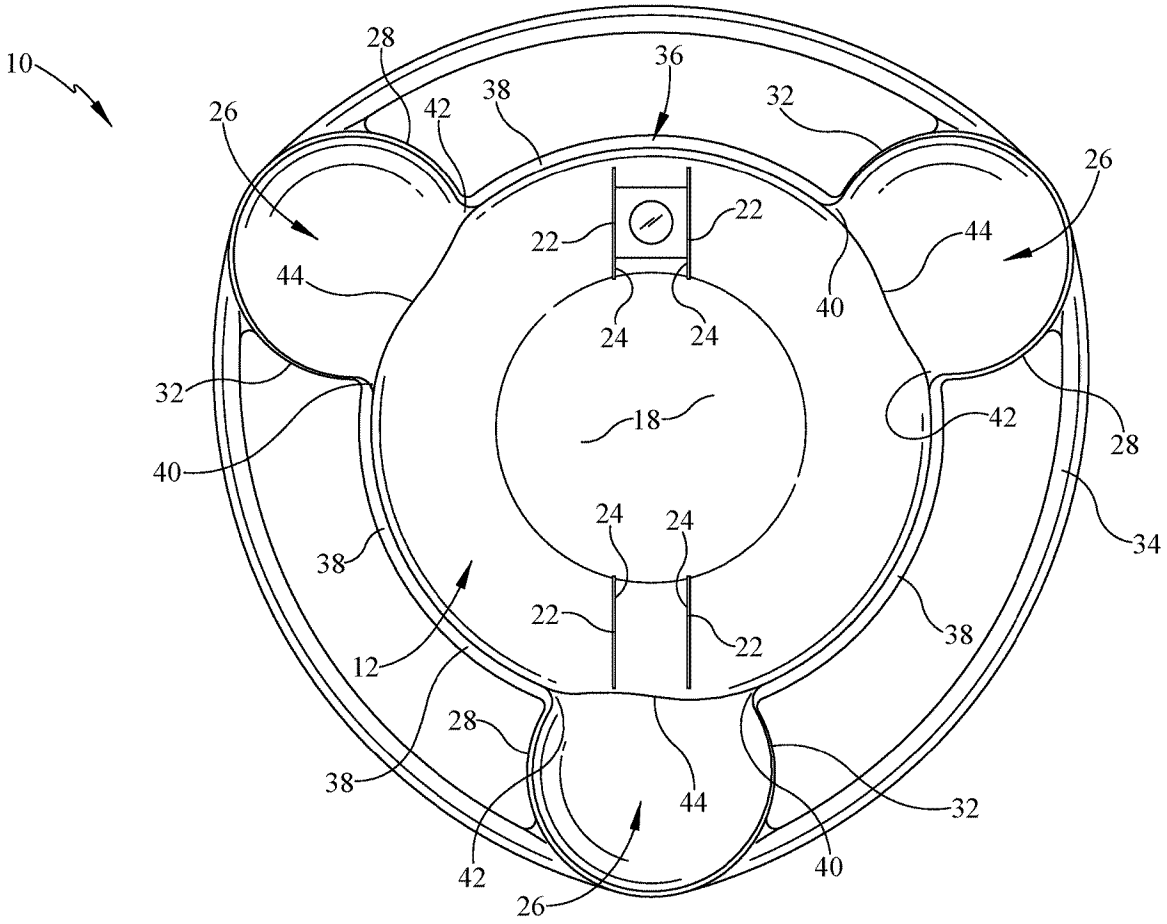
FIG. 4 is a bottom plan view of the flying disk with airfoils.
Figure 5:
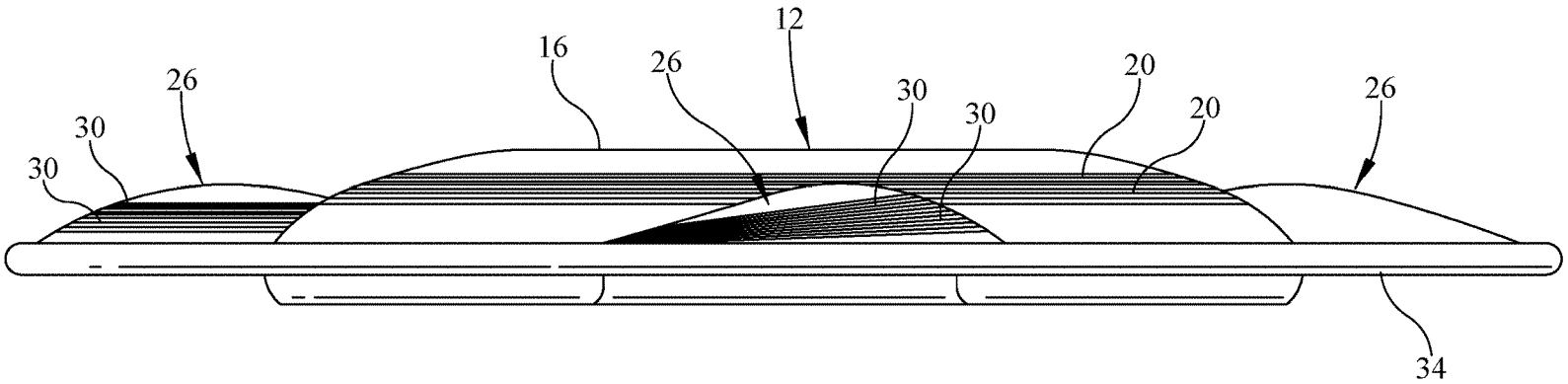
FIG. 5 is an elevation view of the flying disk with airfoils.
Figure 6:
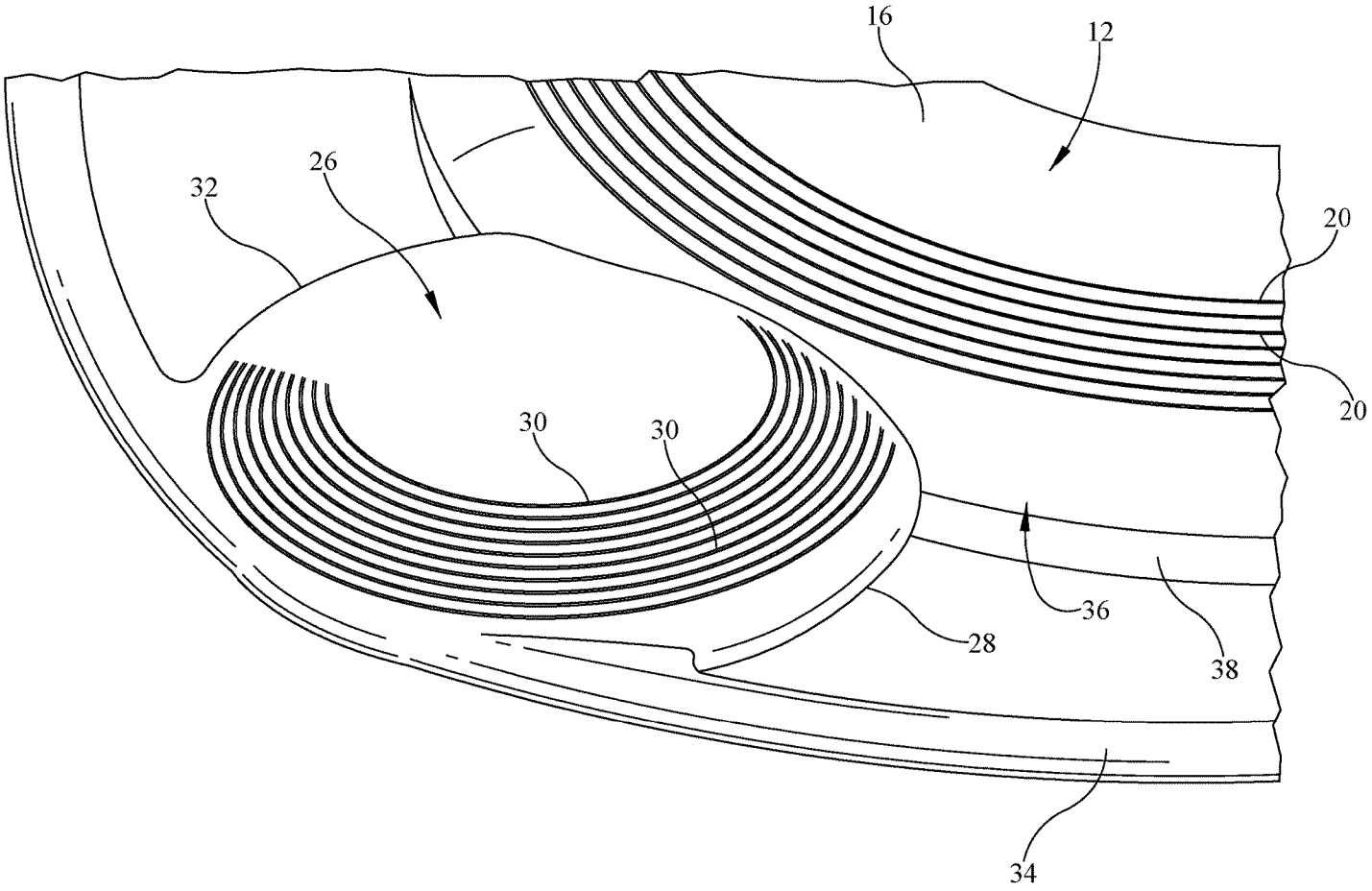
FIG. 6 is a close-up upper perspective view of one of the airfoils attached to the disk member.
Figure 7:
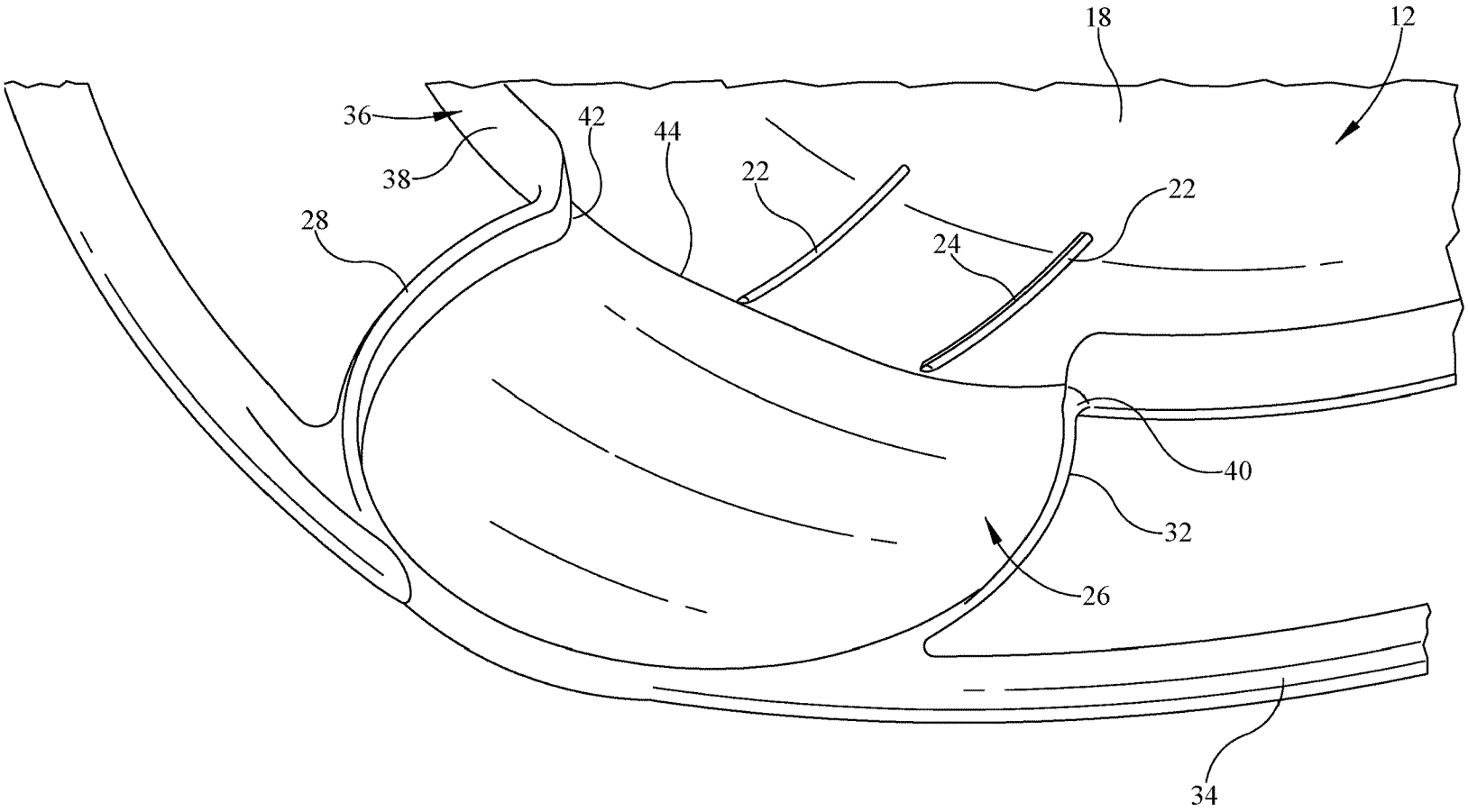
FIG. 7 is a close-up underside perspective view of one of the airfoils attached to the disk member.
Figure 8:
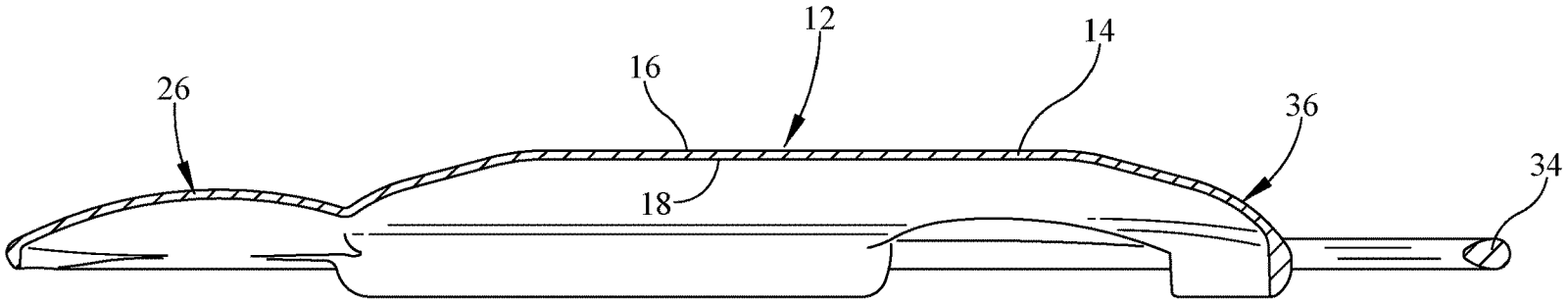
FIG. 8 is a sectioned view of the flying disk with airfoils.
Figure 9:
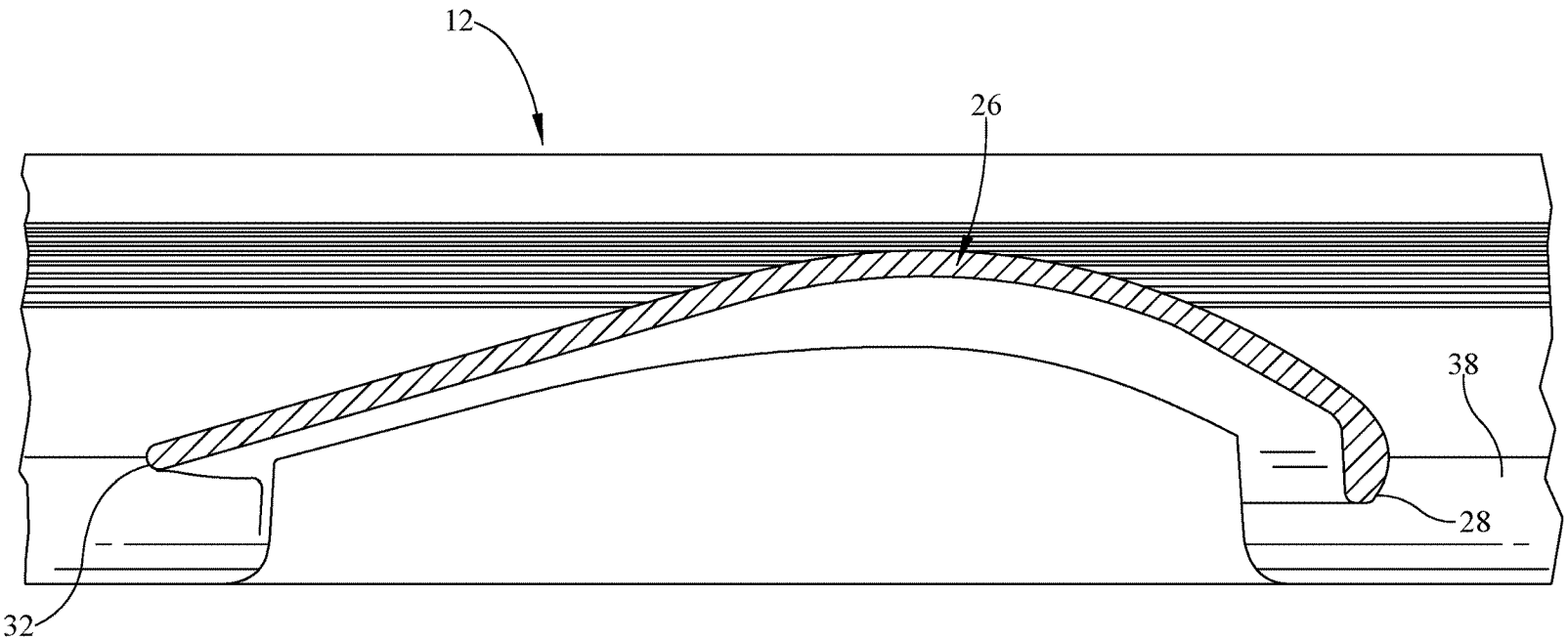
FIG. 9 is a sectioned view of the one of the wings of the flying disk with airfoils.

Referring now to the drawings, it is seen that the flying disk with airfoils of the present invention, generally denoted by reference numeral 10, is comprised of a disk member 12 that has a circular body member 14 with an upper surface 16 and a lower surface 18 forming a top closed dome. One or more circular ridges 20 may be located on the upper surface 16 in order to act a turbulators as is well known in the art of flying disks.

One or more pairs of rails 22 may extend along a portion of the lower surface 18, the rails 22 being located equidistant on opposing sides of a midline passing through the disk member 12. Each rail 22 has a channel 24 such that optional features can be supported within the channels 24, which optional features may include a weight to change the flight dynamics of the flying disk with airfoils 10, an air driven insert whistle or warbler that whistles while the disk member 12 is in flight with an air intake orifice located on the rim 12, a battery that can be used to power a light, such as an LED light, microprocessor circuitry, a gyroscopically stabilized camera (no optional features illustrated), etc. Of course, other means can be used to add the optional features to the disk member 12 such as using cooperating hook and loop material, etc.

As seen, one or more airfoils or wings 26 are attached to the rim 20 of the disk member 12. Each wing 26 is a cambered airfoil that is generally circular and is angled upwardly along its attachment to the disk member 12 so that the leading edge 28 of each wing 26 has an upward angle of attack. Each wing 26 may be asymmetrically cambered on the leading edge 28, as shown, or symmetrically cambered on the wing's center line (not shown). Of course, the wings may have a shape other than circular, including rectangular, tapered, swept, delta, etc.

Each wing 26 may have one or more ridges 30 located on the upper portion of the leading edge 28 in order to act as turbulators—the turbulators can extend to at least a portion of the trailing edge 32 of the wing 26, as shown, or separate turbulators (not illustrated) can be provided on the trail edge 32 of the wing 26. In a multi-wing configuration, the leading edges 28 of each wing 26 face into the direction of rotation of the disk member 12 so that if the flying disk with airfoils 10 flies counterclockwise (for a left-handed user), the leading edge 28 of each wing 26 faces in the counterclockwise direction, as seen in the drawings. If the flying disk with airfoils 10 has three or more wings 26, then the wings 26 are located angularly equidistant from one another. However, if only two wings 26 are used, then the wings 26 are arranged in a boomerang arrangement. As such, the angle at the elbow is between about 90 degrees and about 120 degrees. The elbow is located at the joinder of the central longitudinal axis that passes through each wing 26. The elbow is located forward of the center point of the disk member 12. If each wing has a symmetric camber on the centerline of the wing (and having turbulators on each edge of the wing to make the wing symmetrical about its centerline), then the device becomes ambidextrous as the lift on each wing is independent of left hand or right-hand throw (clockwise or counter clockwise rotation).

The center of gravity of the flying disk with airfoils 10 can be altered by placing weights, such as coins or similar objects within the channels 24 of the rails 22.

As seen, an outer ring 34 or halo can encircle the flying disk with airfoils 10 by being attached to a portion of the outer edge of each wing 26. The outer ring 34 may have a generally circular cross section or may have a somewhat teardrop shaped cross section or even an oval shaped cross section. The outer ring 34 serves several functions. The outer ring 34 acts as a safety guard that makes it not scary to catch the spinning "prop" blades (wings 26). The outer ring 34 acts as a shock absorber on impact and is also a bodily impact absorber. The outer ring 34 provides multi-grip positions to throw the flying disk with airfoils 10 and acts a handle to catch the flying disk with airfoils 10. The outer ring 34 allows small kid's hands to throw the flying disk with airfoils 10 like a typical flying disk with greater ease than throwing the typical flying disk 10 and create rotational momentum and torque in order to yield improved turning backing "boomeranging" of the flying disk with airfoils 10 to the vicinity of the thrower. The outer ring 34 creates slipstream/drafting of preceding air over the wing 26 positioned behind it. The outer ring 34 can be used as a retail display hook, a dog toy grab ring, a children's throw grip, etc.

Looking now to the underside of the flying disk with airfoils 10, it is seen that the flying disk with airfoils 10 has a curved rim 36 that depends downwardly from the flying disk with airfoils 10 along at least a portion of the overall outer periphery of the combined disk member 12 and wings 26. As seen, the overall curved rim 36 is comprised of three rim sections 38 that are each substantially similar in construction and placement to one another. As seen, each rim section 38 begins at a first joinder point 40 of where the trailing edge 32 of a wing 26 meets the disk member 12 and extends away from that wing 26 toward the adjacent wing 26 along the outer periphery of the disk member 12. At a second joinder point 42 where the leading edge 28 of the wing 26 meets the disk member 12, the rim section 38 continues along the outer periphery of this wing 26 continuing herealong until terminating prior to reaching the first joinder point 40 of this wing 26 past the midpoint of the outer periphery of the wing 26 (the rim may also be located along the entire periphery of the flying disk with airfoils 10 so that there would be no termination along the trailing edge of the wings). The rim section 38 tapers downwardly toward the wing 26 surface prior to terminating.

As seen, there is no downwardly dependent rim along the joinder line 44 that extends between the first joinder point 40 and second joinder point 42 of each wing 26. This is an important design feature. In a typical flying disk, such as a FRISBEE, the downwardly dependent circumferential rim makes the overall disk act as an airfoil which gives the disk lift and stability during flight. I previously disclosed a flying disk with airfoils in my patents D724156, issued on Mar. 10, 2015, and D729336, issued on May 12, 2015, which was a typical flying disk with a downwardly dependent circumferential rim wherein there was no discontinuity of the rim along the joinder line whereat each wing was attached to the disk. Through extensive experimentation, I have since discovered that my previous design has certain limitations and that the current design has superior flight characteristics. Specifically, by having such rim discontinuities (no rim along the joinder line 44 as would be the case if the disk member were a typical flying disk with a full circumferential rim), less rim drag is experienced during flight. At the leading wing air intake at the leading edge of the overall flying disk with airfoils 10 (the leading wing 26), incoming linear velocity air meets less underside rim profile drag (due to the rim discontinuity) effectively rotating nose attitude downward about the center of gravity of the disk member 12 down from horizontal. Simultaneously, at the trailing edge air outflow exit of the flying disk with airfoils 10 (the trailing wing 26) the previous incoming leading wing linear velocity airflow now with added rotational airflow velocity now meets with less rim profile drag at the trailing wing due to there being a rim discontinuity (when there is no rim discontinuity, the rim profile drag would push the device tail up and effectively the nose down) and with this reduced trailing wing rim profile drag, the exit velocity at the trailing wing is increased, further reducing the lift generated by the trailing wing which effectively rotates the trailing wing 26 downward about the center of gravity/center of mass of the flying disk with airfoils 10, resulting in an opposing counter moment force to the leading wing's downward moment force, all in relation to the center of gravity/center of mass of the overall device. Simultaneously, less total drag due to less rim profile drag allows flatter flight of device and overall greater total linear velocity across the topside of the leading wing 26 which generates improved wing 26 lift and with that, greater boomerang turning moment as successive wings 26 each rotate into the leading edge position. Less rim drag results in increased linear velocity and also increases boomerang turning moment of each wing 26. The natural result of increased velocity vs pressure results in lift—when drag is reduced (rim discontinuity), the upper surface of both the disk member 12 and the wings 26 experience greater air velocity, resulting in less pressure on these upper surfaces, resulting in greater lift on the wings 26 about the center of gravity.

In order to use the flying disk with airfoils 10 of the present invention, any optional equipment, such as a whistle, a weight, lights, microprocessor circuitry, gyroscopically stabilized camera, etc., is attached and activated as needed. The flying disk with airfoils 10 may be thrown in boomerang style, that is, in an essentially overhand manner with the longitudinal axis of the wings 26 rotating into an almost vertical plane. Alternately, the flying disk with airfoils 10 may be thrown in flying disk style with an essentially cross body horizontal throw with the longitudinal axis of the wings 26 rotating into an almost horizontal plane. The flying disk with airfoils 10 of the present invention captures the beneficial aspects of a flying disk and a boomerang so that the flying disk with airfoils 10 is a combination of two separate airfoil systems and two gyroscopes. Although the flying disk with airfoils 10 has greater drag when compared to a flying disk alone, the flying disk with airfoils 10 has far greater rotational velocity adding gyroscopic stability to the device when compared to a flying disk alone. The wings 26 add greater lift than can be experienced by a standard flying disk as considerable lift is created by the wings 26, especially the outboard end of each wing 26. The wings 26 create flight stability and directional stability versus a normal flying disk with no airfoils. As such, the flying disk with airfoils 10 is capable of greater linear and rotational velocities than can be achieved by a flying disk alone.

The disk member 12, each wing 26, and the outer ring 34 are each made from a suitable material, such as plastic and each may be formed as an individual unit and attached to its respective other components, or the flying disk with airfoils 10 may be made as a monolithic unit.

While the invention has been particularly shown and described with reference to an embodiment thereof, it will be appreciated by those skilled in the art that various changes in form and detail may be made without departing from the spirit and scope of the invention.

I claim:

1. An aerodynamic flying device comprising:

a disk member having and having an upper surface and an opposing lower surface;

a cambered wing having a leading edge, a trailing edge, and an outer edge between the leading edge and the trailing edge, the wing attached directly to the flying disk along a joinder line, the disk member and the attached wing having an overall outer periphery;

a first turbulator located on the leading edge of the wing; and a downwardly depending curved rim located along the outer periphery such that there is a first discontinuity of the rim along the joinder line.

2. The aerodynamic flying device as in claim 1 further comprising attachment means for attaching an accessory to the disk member.

3. The aerodynamic flying device as in claim 2 wherein the attachment means comprises a pair of coextensive rails located on the lower surface such that the accessory is held between the pair of rails.

4. The aerodynamic flying device as in claim 1 wherein the disk member is cambered.

5. The aerodynamic flying device as in claim 1 wherein the wing is symmetrically cambered along a midline passing through the wing.

6. The aerodynamic flying device as in claim 1 wherein the wing is asymmetrically cambered along a midline passing through the wing.

7. The aerodynamic flying device as in claim 1 further comprising a second turbulator located on the trailing edge of the wing.

8. The aerodynamic flying device as in claim 1 wherein the flying disk and the wing are monolithic in construction.

9. The aerodynamic flying device as in claim 1 further comprising a ring member attached to a portion of the outer edge of the wing.

10. The aerodynamic flying device as in claim 1 further comprising a second discontinuity of the rim along the trailing edge of the wing.

11. The aerodynamic flying device as in claim 10 wherein the flying disk, the first wing, the second wing, and the third wing are all monolithic in construction.

12. An aerodynamic flying device comprising:

a disk member having a closed dome and having an upper surface and an opposing lower surface;

a cambered first wing having a first leading edge, a first trailing edge, and a first outer edge between the first leading edge and the first trailing edge, the first wing attached directly to the disk member along a first joinder line;

a cambered second wing having a second leading edge, a second trailing edge, and a second outer edge between the second leading edge and the second trailing edge, the second wing attached directly to the disk member along a second joinder line;

a cambered third wing having a third leading edge, a third trailing edge, and a third outer edge between the third leading edge and the third trailing edge, the third wing attached directly to the disk member along a third joinder line, such that the first wing, the second wing, and the third wing are spaced equidistantly apart from one another about the flying disk and such that the disk member, the attached first wing, the attached second wing, and the attached third wing having an overall outer periphery; and a downwardly depending curved rim located along the outer periphery such that there is a first discontinuity of the rim along the first joinder line, a second discontinuity of the rim along the second joinder line, and a third discontinuity of the rim along the third joinder line.

13. The aerodynamic flying device as in claim 12 further comprising attachment means for attaching an accessory to the disk member.

14. The aerodynamic flying device as in claim 13 wherein the attachment means comprises a pair of coextensive rails located on the lower surface such that the accessory is held between the pair of rails.

15. The aerodynamic flying device as in claim 12 wherein the disk member is cambered.

16. The aerodynamic flying device as in claim 12 further comprising:

a first turbulator located on the first leading edge of the first wing;

a second turbulator located on the second leading edge of the second wing; and a third turbulator located on the third leading edge of the third wing.

17. The aerodynamic flying device as in claim 16 wherein the first wing is symmetrically cambered along a first midline passing through the first wing, the second wing is symmetrically cambered along a second midline passing through the second wing, and the third wing is symmetrically cambered along a third midline passing through the third wing.

18. The aerodynamic flying device as in claim 16 wherein the first wing is asymmetrically cambered along a first midline passing through the first wing, the second wing is asymmetrically cambered along a second midline passing through the second wing, and the third wing is asymmetrically cambered along a third midline passing through the third wing.

19. The aerodynamic flying device as in claim 16 further comprising:

a fourth turbulator located on the first trailing edge of the first wing;

a fifth turbulator located on the second trailing edge of the second wing; and a sixth turbulator located on the third trailing edge of the third wing.

20. The aerodynamic flying device as in claim 12 further comprising a ring member attached to a first portion of the first outer edge of the first wing, to a second portion of the second outer edge of the second wing, and to a third portion of the outer edge of the third wing.

21. The aerodynamic flying device as in claim 12 further comprising a fourth discontinuity of the rim along the first trailing edge of the first wing, a fifth discontinuity of the rim along the second trailing edge of the second wing, and a sixth discontinuity of the rim along the third trailing edge of the third wing.

22. An aerodynamic flying device comprising:

a disk member having and having an upper surface and an opposing lower surface;

a cambered wing having a leading edge, a trailing edge, and an outer edge between the leading edge and the trailing edge, the wing attached directly to the flying disk along a joinder line, the disk member and the attached wing having an overall outer periphery;

a ring member attached to a portion of the outer edge of the wing; and a downwardly depending curved rim located along the outer periphery such that there is a first discontinuity of the rim along the joinder line.

23. The aerodynamic flying device as in claim 22 further comprising attachment means for attaching an accessory to the disk member.

24. The aerodynamic flying device as in claim 23 wherein the attachment means comprises a pair of coextensive rails located on the lower surface such that the accessory is held between the pair of rails.

25. The aerodynamic flying device as in claim 22 wherein the disk member is cambered.

26. The aerodynamic flying device as in claim 22 further comprising a second discontinuity of the rim along the trailing edge of the wing.

27. An aerodynamic flying device comprising:

a disk member having and having an upper surface and an opposing lower surface;

a cambered wing having a leading edge, a trailing edge, and an outer edge between the leading edge and the trailing edge, the wing attached directly to the flying disk along a joinder line, the disk member and the attached wing having an overall outer periphery;

a second discontinuity of the rim along the trailing edge of the wing; and a downwardly depending curved rim located along the outer periphery such that there is a first discontinuity of the rim along the joinder line.

28. The aerodynamic flying device as in claim 27 further comprising attachment means for attaching an accessory to the disk member.

29. The aerodynamic flying device as in claim 28 wherein the attachment means comprises a pair of coextensive rails located on the lower surface such that the accessory is held between the pair of rails.

30. The aerodynamic flying device as in claim 27 wherein the disk member is cambered.

* * * * *